United States Patent [19]

Carlsson et al.

[11] Patent Number: 5,009,583

[45] Date of Patent: Apr. 23, 1991

[54] SHAFT SEAL AND BEARING MEMBERS FOR A ROTARY SCREW COMPRESSOR

[75] Inventors: Anders Carlsson, Ingarö ; Lars Johansson, Stavsnäs; Frits Söderlund, Saltsjöbaden, all of Sweden

[73] Assignee: Svenska Rotor Maskiner AB, Stockholm, Sweden

[21] Appl. No.: 595,675

[22] Filed: Oct. 9, 1990

Related U.S. Application Data

[63] Continuation of Ser. No. 399,513, Aug. 28, 1989, abandoned.

[30] Foreign Application Priority Data

Mar. 19, 1987 [SE] Sweden ..... 8701123

[51] Int. Cl.[5] ..... F04C 18/16; F04C 27/00

[52] U.S. Cl. ..... 418/104; 418/201.1; 277/96.1

[58] Field of Search ..... 418/104, 201 R, 201 A, 418/201 B; 277/91.6, 174, 136, 100 BS, 27, 144, 143

[56] References Cited

U.S. PATENT DOCUMENTS

| | | | |
|---|---|---|---|
| 3,271,037 | 9/1966 | Hammond | 277/27 |
| 3,527,465 | 9/1970 | Guinard | 277/96.1 |
| 3,717,353 | 2/1973 | Rayfield | 277/96.1 |
| 4,407,512 | 10/1983 | Trytek | 277/96.1 |
| 4,482,159 | 11/1984 | Ishitani et al. | 277/27 |
| 4,487,563 | 12/1984 | Mori et al. | 418/201 R |
| 4,557,679 | 12/1985 | Mori et al. | 418/201 R |

FOREIGN PATENT DOCUMENTS

| | | | |
|---|---|---|---|
| 1146482 | 3/1985 | U.S.S.R. | 418/201 R |

*Primary Examiner*—Leonard E. Smith
*Assistant Examiner*—David L. Cavanaugh
*Attorney, Agent, or Firm*—Frishauf, Holtz, Goodman & Woodward

[57] ABSTRACT

A screw rotor machine comprises a pair of intermeshing rotors (3) having helical lands and intervening grooves and a casing with a working space generally comprised of two intersecting bores, each enclosing one of the rotors (3). Each rotor (3) has a cylindrical projection (9) passing through a hole (8) in an end wall (5) at the high pressure end of the machine into a bearing chamber. To prevent gas leakage from the working space to the bearing chamber there is provided an annular element (15; 23) surrounding each rotor projection (9) and non-rotatably fixed to the casing. The annular element is provided with one axial (19; 24) and one radial (20; 21) sealing surface, one surface (19; 21) cooperating with the casing and the other surface (20; 24) cooperating with the rotor projection (9) by a slight or zero contact force. The annular element (15; 23) is movable almost without friction in the direction of the contact force. Since the annular element (15; 23) has only one radial sealing surface (20; 21), cooperating with either the rotor projection (9) or the casing, the annular element will seal effectively even if the axis of the hole (8) in the end wall (5) and that of the rotor projection (9) are non-aligned.

3 Claims, 3 Drawing Sheets

SHAFT SEAL AND BEARING MEMBERS FOR A ROTARY SCREW COMPRESSOR

This application is a continuation, of applicaton Ser. No. 07/399,513, filed Aug. 28, 1989, now abandoned.

BACKGROUND OF THE INVENTION

The present invention relates to a screw rotor machine for a working fluid comprising a pair of intermeshing rotors having helical lands and intervening grooves, and a casing with a working space generally comprised of two intersecting bores, each enclosing one of the rotors, said casing having a low pressure end section, a high pressure end section carrying bearings for the rotors and an intermediate barrel section, said barrel section being connected to at least one of said end sections by a detachable joint, said high pressure end section being provided with a bearing chamber separated from the working space by an end wall provided with holes, each freely surrounding a cylindrical projection of a rotor.

Due to the necessary manufacturing and running clearances in a practical machine a leakage path exists for the high pressure gas to escape from the working space to the bearing chamber in the high pressure end section. The gas thereby leaks from a working chamber radially through the axial clearance between the end surfaces of the rotors and the inner surface of the high pressure end wall to the cylindrical rotor projections. From there the leaking gas flows axially through the radial clearance between each cylindrical rotor projection and the related hole in the end wall into the bearing chamber. To avoid that this gas leakage builds up a pressure in the bearing chamber equivalent to the discharge pressure, as such a pressure would exert an additional axial load to the rotors, provisions are usually taken for allowing the gas to escape from the bearing chamber. Thus it is important to minimize the gas leakage from the working space to the bearing chamber in order to reduce the decrease of the eficiency of the machine resulting from the losses of high pressure gas.

Owing to the deflection of the rotors resulting from radial forces acting thereon, there must be a certain clearance between each rotor projection and the related hole in the end wall to avoid the risk for seizing therebetween. To reduce the leakage by diminishing the clearances to a minimum corresponding to said necessary raunning clearances not only requires narrow tolerances for the cylindrical rotor projections and the related holes in the end section but also necessitates a precise positioning of the low and high pressure end sections relative to each other. When mounting an end section to the barrel section, the end section, due to the play between the fastening bolts and the respective holes in the end section, is movable to a certain degree before the bolts are drawn tight. The end section therefore has to be displaced and angularly adjusted within the limits of said play in order to adjust the position thereof so that the holes in the end section receiving the rotor projections will be aligned with those of the other end section. When the end section is adjusted to the proper position it has to be fixed in this position by means of guiding pins until the bolts are drawn tight. With this extensive adjusting procedure that is necessary for diminishing the clearance to a minimum the manufacturing costs will be increased.

Different kinds of contact seals therefore have been used to prevent gas leakage from the high pressure end of the working space to the bearing chamber in the high pressure end section. See for example the article "Gleitringsdichtungen für Schraubenmashinen - Stand der Technik" by K. H. Victor published in VDI Berichte 521 entitled "Schraubenmaschinen", pages 49–76, VDI-Verlag GmbH, Düsseldorf, 1984. Many of such contact seals are of complicated construction with sustantial axial length and require supply of oil to cool the seal. The distance between the rotor body and the radial bearings is thereby increased to make space for the sealing arrangement which results in a greater deflection of the rotors. Furthermore, the contact seals give rise to friction losses which negatively affects the efficiency of the machine.

Another way of solving this problem is to use a sealing liquid for blocking the gas leakage. An example of this kind of sealing is disclosed in U.S. Pat. No. 3,462,072 showing a screw compressor in which oil having a pressure exceeding the discharge pressure is supplied from a pressure oil source through a channel in the high pressure end section to annular grooves therein, each of those grooves surrounding one of the shafts. this oil blocks the flow of working fluid along the shafts and thus acts as a sealing liquid between the working space and the bearing chambers in the high pressure end section. A fraction of the oil flows along the shafts into the working space, but most of the oil flows along the shafts in the opposite direction to the bearing chambers and lubricates the bearings. The bearing chambers are drained through a channel in the casing to an opening in the barrel wall of the compressor.

Also, this method of sealing has disadvantages. The oil drained to the compressor will have a considerably higher temperature than the temperature of the working fluid in the working chamber to which the oil is returned. The contact between the working fluid and the oil therefore results in heating of the working fluid which decreases the volumetric efficiency. Furthermore the oil has to be accelerated to the tip speed of the rotor lobes which also consumes power. Another drawback with a sealing arrangement of this kind is that the oil leaking out into the working space exerts an additional axial load to the rotors.

The object of the present invention therefore is to prevent gas leakage along the rotor projections at the high pressure end of a screw rotor machine as defined, in a way not entailing the disadvantages connected to the solutions according to known techniques.

SUMMARY OF THE INVENTION

The above object has been achieved in that a screw rotor machine of the kind described herein is provided with one separate annular element, surrounding each one of the rotor projections and non-rotatably fixed to the causing, said annular element being provided with one axial and one radial sealing surface, one surface cooperating with the casing and the other one cooperating with the rotor projection by a slight or zero contact force, the annular element being movable almost without friction in the direction of said contact force.

By the sealing arrangement according to the invention gas leakage from the working space to the bearing chamber is effectively prevented in a simple and reliable way which requires no supply of fluid for blocking or cooling purpose. The seal can be made with small axial and radial dimensions and works without any friction losses. The invention therefore is particularly useful when applied to small machines.

The annular of the invention cooperates by one sealing surface with the casing and by another sealing surface with the rotor projection. As the annular element is non-rotatably fixed to the casing, the sealing between the element, and the casing is established simply by direct contact of surfaces that do not rotate relative each other. At the other sealing surface of the annular element there is relative motion between said surface and the cooperating surface of the rotor projection. The clearance between these surfaces is very small and due to the freedom of the annular element to move perpendicular to these cooperating surfaces there is practically no contact force between them.

Since the sealing of the rotor projection is established in cooperation with the annular element, the size of the clearance between the projection and the related hole in the end wall has no influence upon the gas leakage. The clearance can therefore be made wide enough to allow a certain misalignment between the axis of the projection and that of the hole. This simplifies the assembly of the machine as the tolerances for the surfaces determining the relative position of said axes do not have to be particular narrow. When mounting the high pressure end section to the barrel section it is therefore sufficient with the precision attained with the fastening bolts, and there will thus be no need for a precise adjustment of the position of the end section. Thus, the manufacturing costs are reduced.

The invention will hereinafter be discribed more in detail with reference to embodiments shown in the accompanying drawings.

DETAILED DESCRIPTION

Figure 1:
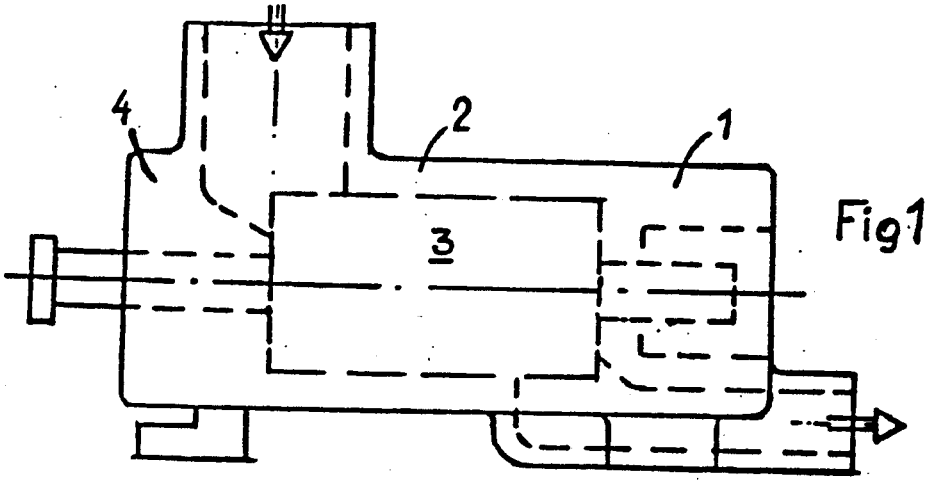
FIG. 1 is a schematic view of a screw compressor according to the invention.
Figure 4:
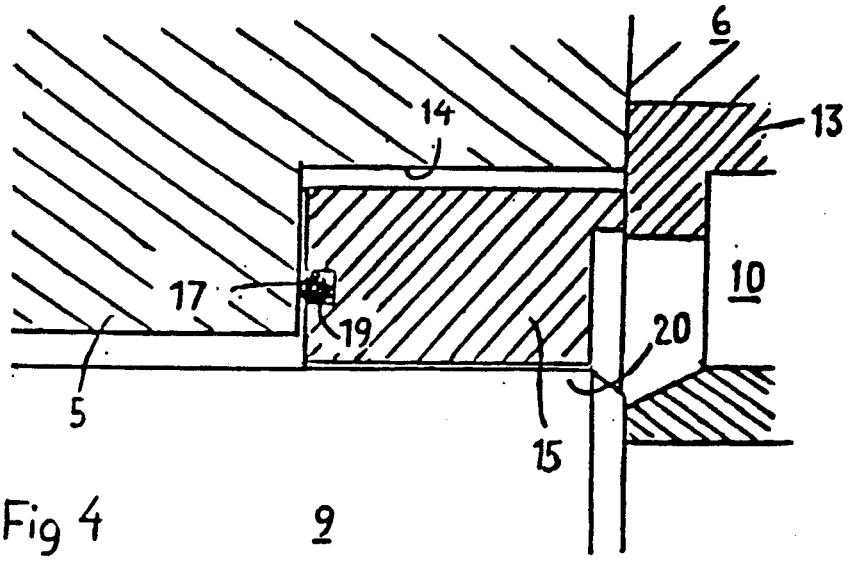
FIG. 4 is an enlarged view of a detail in FIG. 2.
Figure 5:
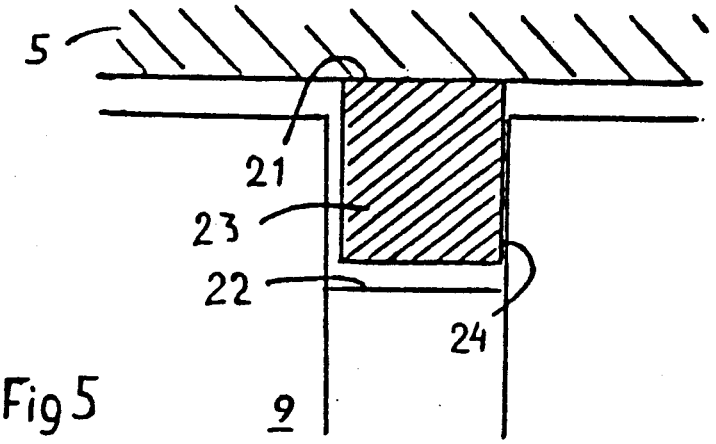
FIG. 5 is an enlarged view of a detail in FIG. 3.

In FIG. 1 a screw compressor is shown. The compressor comprises a casing with a working space generally comprised of two intersecting bores, each enclosing a rotor, of which only one 3 is shown in the figure. The rotors have helical lands and intervening grooves which intermesh to form chevron-shaped working chambers between the rotors and the casing. The casing is comprises of a low pressure end section 4, a high pressure end section 1 and an intermediate barrel section 2.

Figure 2:
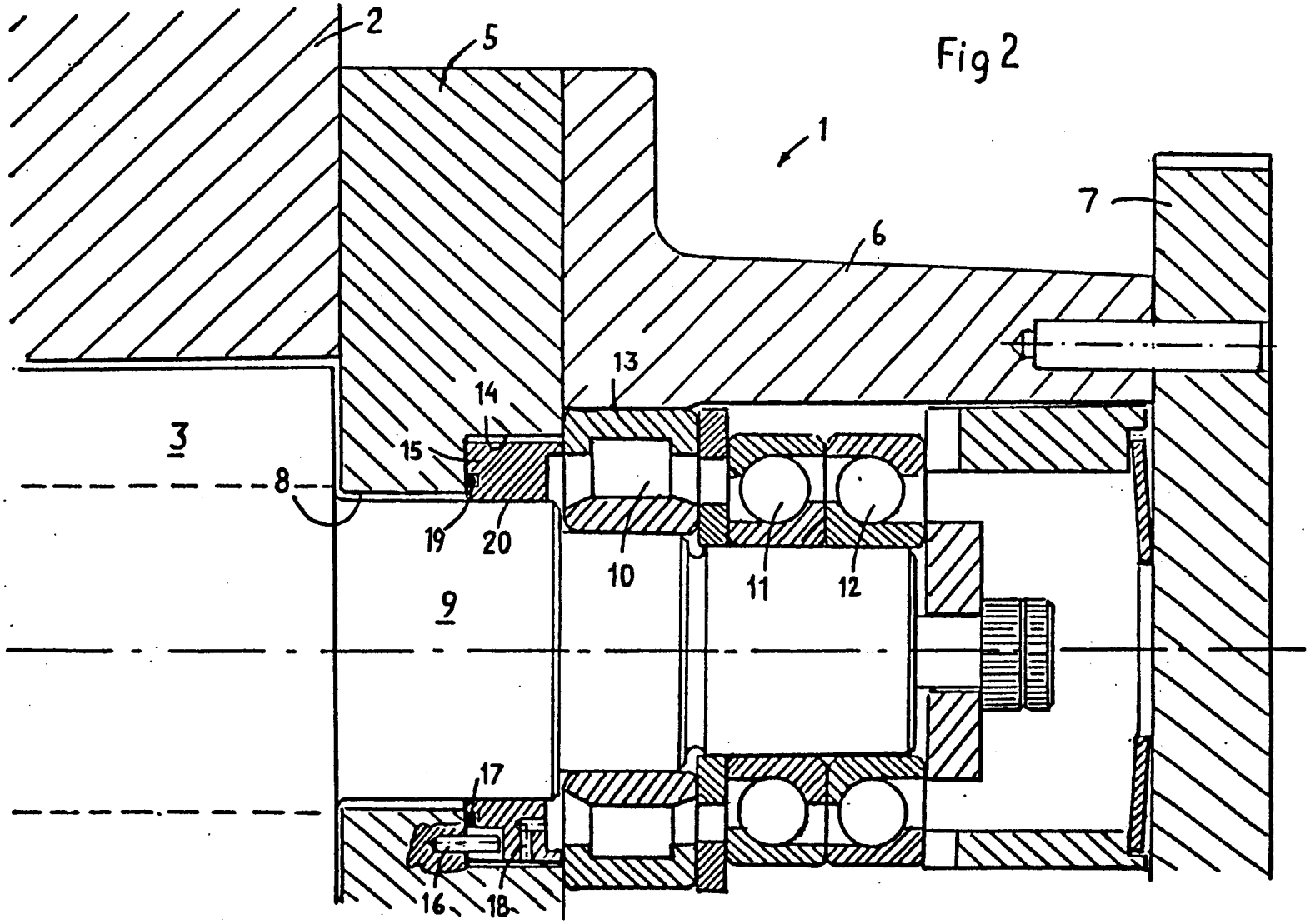
FIG. 2 is a fragmentary sectional view of a compressor according to one embodiment of the invention showing a part of the high pressure end.

In FIG. 2 a part of the high pressure end section 1 is shown. It comprises an end wall 5, a bearing chamber casing 6 and a cover plate 7 and is detachably joined to the barrel section 2 by bolts not shown.

The end wall 5 is provided with holes 8, each of which freely surrounds a rotor projection 9. Each rotor projection is journalled in radial rolling bearing 10 and thrust bearings 11, 12. The outer ring 13 of the radial rolling bearing 10 is mounted to abut the end wall 5. Coaxially with each hole 8 in the end wall 5 there is a recess 14 in the same on the side thereof facing the bearing chamber. In each recess 14 an annular element 15 is provided, which surrounds the rotor projection 9 between the bottom of the recess 14 and the radial rolling bearing 10. The annular element 15 is secured against rotation by means of a pin 16 extending through a slot in the annular element 15 and a bore in the end wall 5. By an O-ring 17 provided in a groove in the annular element 15 the element 15 is biased against the outer ring 13 of the radial rolling bearing 10. The outer diameter of the annular element 15 is smaller than the diameter of the recess 14 so that the annular element 15 is free to move a certain distance in the radial direction. The radial positon of the annular element 15 therefore is determined solely by the location of the rotor projection 9 and makes it possible to leave only a running clearance between the annular element 15 and the rotor projection 9. Due to the fact that this clearance between the inner surface 20 of the annular element 15 and the rotor projection 9 can be made very narrow, an effective sealing action is established therebetween, and as a result of the freedom of the annular element 15 to move radially, practically no contact forces will be developed if the surfaces contact each other. For lubrication of the bearings, oil is introduced to the annular space outside the annular element 15. From there the oil is supplied to the bearings 10, 11, 12 through a channel 18 in the annular element 15.

When the compressor is in operation, high pressure gas reaches the annular element 15 through the radial clearance between the hole 8 and the rotor projection 9. The gas is prevented from reaching the bearing chamber by the O-ring 17 between the end wall 5 and the bottom 19 of the groove in the annular element 15 and by the cooperating surfaces of the annular element 15 and the rotor projection 9, so that the pressure in the bearing chamber can be kept at a low level.

A proper sealing effect is assured irrespectively of the accuracy of the centering of the end wall 5 in relation to the working space, as the annular element 15 due to its freedom to move radially in relation to the end section will be positioned aligned with the axis of the rotor projection 9 even if the latter is offset to the axis of the hole 8 in the end wall 5.

Although the radial contact force between the annular element 15 and the rotor projection 9 will be almost negligible, it is advantageous to produce the element 15 from a wear-resisting material having good anti-friction properties in relation to the material in the cooperating rotor projection 9.

Figure 3:
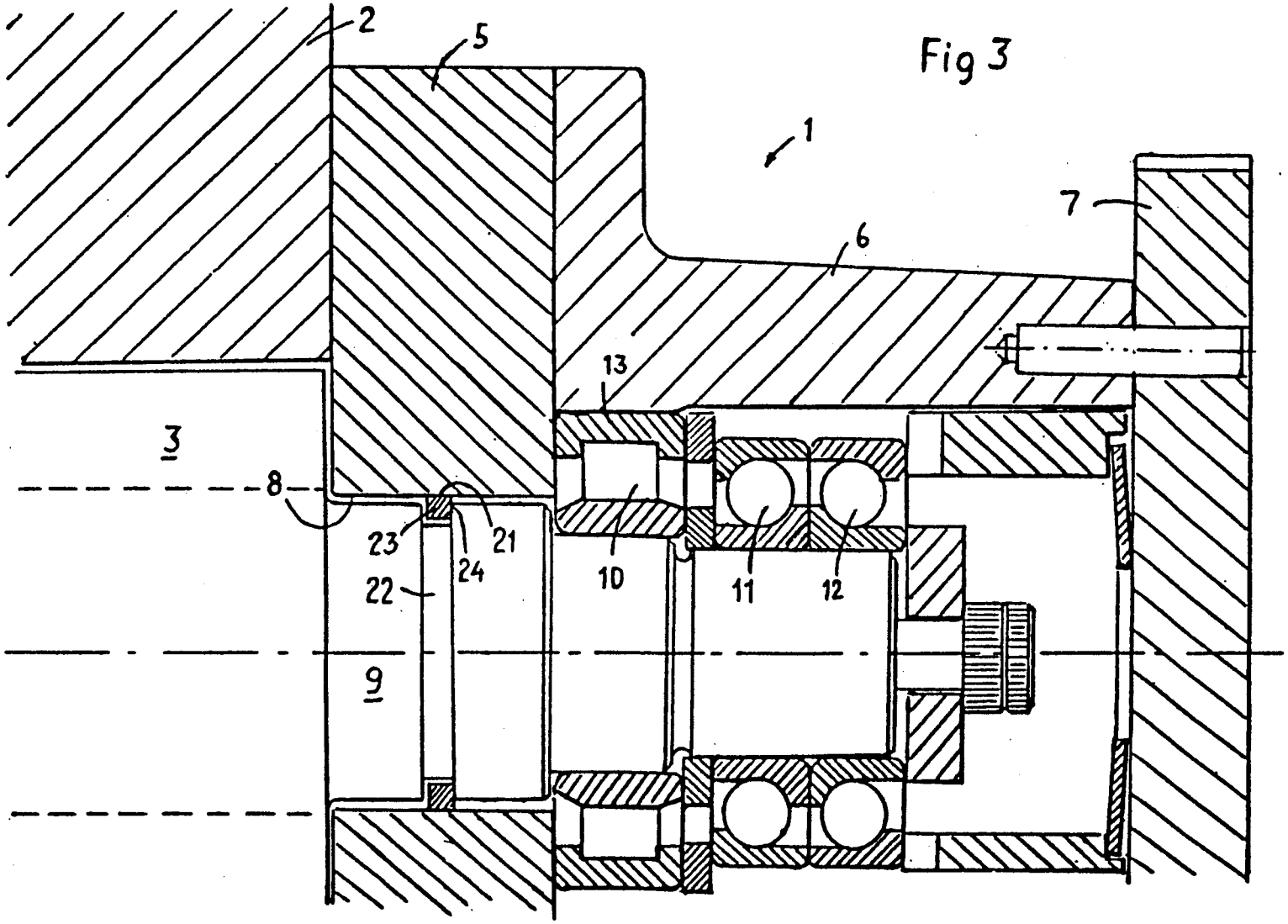
FIG. 3 is a view similar to FIG. 2 but showing another embodiment of the invention.

FIG. 3 is a section similar to that of FIG. 2 but showing another embodiment of the invention. Elements common to corresponding elements in FIG. 2 have the same reference numerals.

In the embodiment of FIG. 3, each rotor projection 9 is provided with an annular groove 22 receiving the annular member which is made as an elastic split-ring 23 with an axial and radial clearance therebetween. The split-ring 23 is by its own spring effect biased outwards against the hole 8 in the end wall 5. A correct dimensioning of the split-ring 23 in order to attain a well-adjusted spring force is thereby of high importance. The spring force must be great enough to assure that the ring 23 circumferentially contacts the wall of the hole 8. It shall, however, not be particularly greater than that as it is essential that the friction between the ring 23 and the hole 8 is low. The small friction force between the radially outer surface 21 of the split-ring 23 and the hole 8 is sufficient to prevent the split-ring 23 from rotating together with the rotor projection 9. The split-ring 23 is positioned to abut with one of its end surfaces 24 against one of the axial side walls of the groove 22 in the rotor projection 9 to sealingly cooperate therewith. As axial displacement of the split-ring 23 within the groove 22 is counter-acted only by the small friction force between the split-ring 23 and the hole 8, the contact force between the split-ring 23 and the abutting surface of the side wall in the annular groove 22 will be negligible.

High pressure gas reaching the split-ring 23 through the radial clearance between the rotor projection 9 and the hole 8 in the end wall 5 is prevented from leaking to the bearing chamber by the sealing effect established by the outer surface 21 on the split-ring 23 contacting the wall of the hole 8 on one hand and on the other hand by the relatively rotating axial end surface 24 of the split-ring 23 and the side wall surface of the groove 22 abutting thereupon.

The clearance between the radially inner surface of the split-ring 23 and the bottom of the annular groove 22 is large enough to take up any disalignment between the axis of the rotor projection 9 and the axis of the hole 8 in the end wall 5.

We claim:

1. In a screw rotor machine for a working fluid, comprising:

a pair of intermeshing rotors (3) having helical lands and intervening grooves; and a casing with a working space generally comprised of two intersecting bores, each enclosing one of the rotors (3), said casing having a low pressure end section (4), a high pressure end section (1) carrying bearings (10, 11, 12) for the rotors (3) and an intermediate barrel section (2), said intermediate barrel section (2) being connected to at least one of said end sections (1, 4) by means of a detachable joint, and said high pressure end section (1) being provided with a bearing chamber separated from the working space by an end wall (5) provided with a plurality of holes (8), each hole freely surrounding a cylindrical projection (9) of a rotor (3), the improvement comprising:

a separate annular element (15) axially fixed with respect to said end section and surrounding each one of the respective rotor projections (9), the annular elements (15) each having a radial inner surface (20) which forms a sealing surface with a running clearance, said sealing surface cooperating with the respective rotor projection (9) by a very slight radial contact sealing force;

the end section having a recess within which said annular element is free to move to a certain distance in the radial direction; and the annular elements (15) each being radially movable substantially without friction in the casing, always to maintain position alignment with the axis of the rotor projection, and being in axial sealing contact with the casing, the annular elements (15) each being non-rotatably fixed to the casing.

2. The machine of claim 1, wherein said annular elements (15) each have an end face with is provided with a groove enclosing an O-ring (17) for biasing another end face thereof into direct contact with a surface fixed in the casing.

3. The machine of claim 2, wherein said fixed surface in the casing comprises an end surface of an outer ring (13) of a radial bearing (10), which radial bearing comprises a bearing for the rotors.

* * * * *